US006461184B2

(12) United States Patent
Nimura

(10) Patent No.: US 6,461,184 B2
(45) Date of Patent: Oct. 8, 2002

(54) CONNECTOR

(75) Inventor: Kazuhiko Nimura, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/742,442

(22) Filed: Dec. 22, 2000

(65) Prior Publication Data

US 2001/0006860 A1 Jul. 5, 2001

(30) Foreign Application Priority Data

Dec. 24, 1999 (JP) ..... 11-366709

(51) Int. Cl.[7] ..... H01R 13/627
(52) U.S. Cl. ..... 439/352; 439/620; 439/872
(58) Field of Search ..... 439/352, 353, 439/620, 354, 871, 872, 607–610

(56) References Cited

U.S. PATENT DOCUMENTS

| | | | | |
|---|---|---|---|---|
| 5,489,220 A | * | 2/1996 | Hanna et al. | 439/620 |
| 5,647,757 A | * | 7/1997 | Chrysostomou | 439/352 |
| 5,895,282 A | * | 4/1999 | Little | 439/332 |
| 6,019,638 A | | 2/2000 | Saka et al. | 439/620 |
| 6,234,843 B1 | * | 5/2001 | Pavlovic | 439/620 |

FOREIGN PATENT DOCUMENTS

| | | |
|---|---|---|
| EP | 917 251 | 5/1999 |

* cited by examiner

*Primary Examiner*—P. Austin Bradley
*Assistant Examiner*—Ross Gushi
(74) *Attorney, Agent, or Firm*—Banner & Witcoff, Ltd.

(57) ABSTRACT

The invention provides a connector with improved operability during the joining operation of electric wires and terminal fittings, and during the attachment of ferrite cores.

A connector is provided with conducting members 20 capable of making contact with corresponding terminal fittings, a ferrite core 25 which is attached from the exterior to the conductive members 20, electric wire terminal fittings 27 capable of making contact with electric wires 36 and the conducting members 20, and a housing 10 which houses all of the above. The conducting members 20, to which the ferrite core 25 is attached, are formed separate from the members (the electric wire terminal fittings 27) that connect with the electric wires 36. Consequently, an automated device is able to connect the electric wire terminal fittings 27 and the electric wires 36.

13 Claims, 8 Drawing Sheets

CONNECTOR

TECHNICAL FIELD

The present invention relates to an electrical connector.

BACKGROUND TO THE INVENTION

An air-bag electrical circuit of an automobile typically has a ferrite core provided thereon in order to reduce noise along this circuit. One example of this is described in JP 11-144796. In this example, ferrite cores are attached to the exterior of electric wires, at a location close to the ends thereof, and terminal fittings are crimped to these electric wires at locations which are closer than the ferrite cores to the ends. The terminal fittings and the ferrite cores are housed, together with the ends of the electric wires, within a connector housing.

In the connector described above, in which the ferrite cores are attached to the exterior of electric wires, the outer dimension of the terminal fittings is greater than that of the electric wires. Consequently, these terminal fittings become an obstacle after they have been crimped to the ends of the electric wires, in that they prevent the ferrite cores from being fitted. As a result, when the joining operation is taking place, the ferrite cores are attached first, and then the ends of the electric wires are placed in a crimping device and the terminal fittings are crimped thereto. However, when the ferrite cores are in an attached state with the outside of the electric wires, it is difficult to automate the process of delivering the electric wires to their crimping location and of pulling out the electric wires which have been crimped. These operations must be performed manually. Consequently, the operability of the joining operation needs to be improved.

The present invention has taken the above problem into consideration, and aims to present a connector in which operability is improved when joining electric wires and terminal fittings, and when attaching ferrite cores.

SUMMARY OF THE INVENTION

According to the invention there is provided an intermediate metal conducting member assembly comprising:

an intermediate metal conducting member having a first connection portion at a first end thereof and a second connection portion at a second end thereof, said first and second connection portions being configured to respectively engage with, and bridge mating metal contact members to provide an electrical circuit, and a noise shielding member substantially surrounding said intermediate metal conducting member so as in use to shield said electrical circuit against electrical noise.

Since the conducting member is releasably attachable to mating contact members, a contact member can itself be attached to an electric wire separately from the attachment of the ferrite core.

Preferably the conducting member protrudes in an attachment direction, and said housing defines a cavity in said attachment direction and aligned with said conducting member to permit insertion of said terminal fitting from the exterior for engagement with said conducting member.

In the preferred embodiment the connector has two conducting members and a single ferrite core having two apertures therethrough, one aperture for each conducting member.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
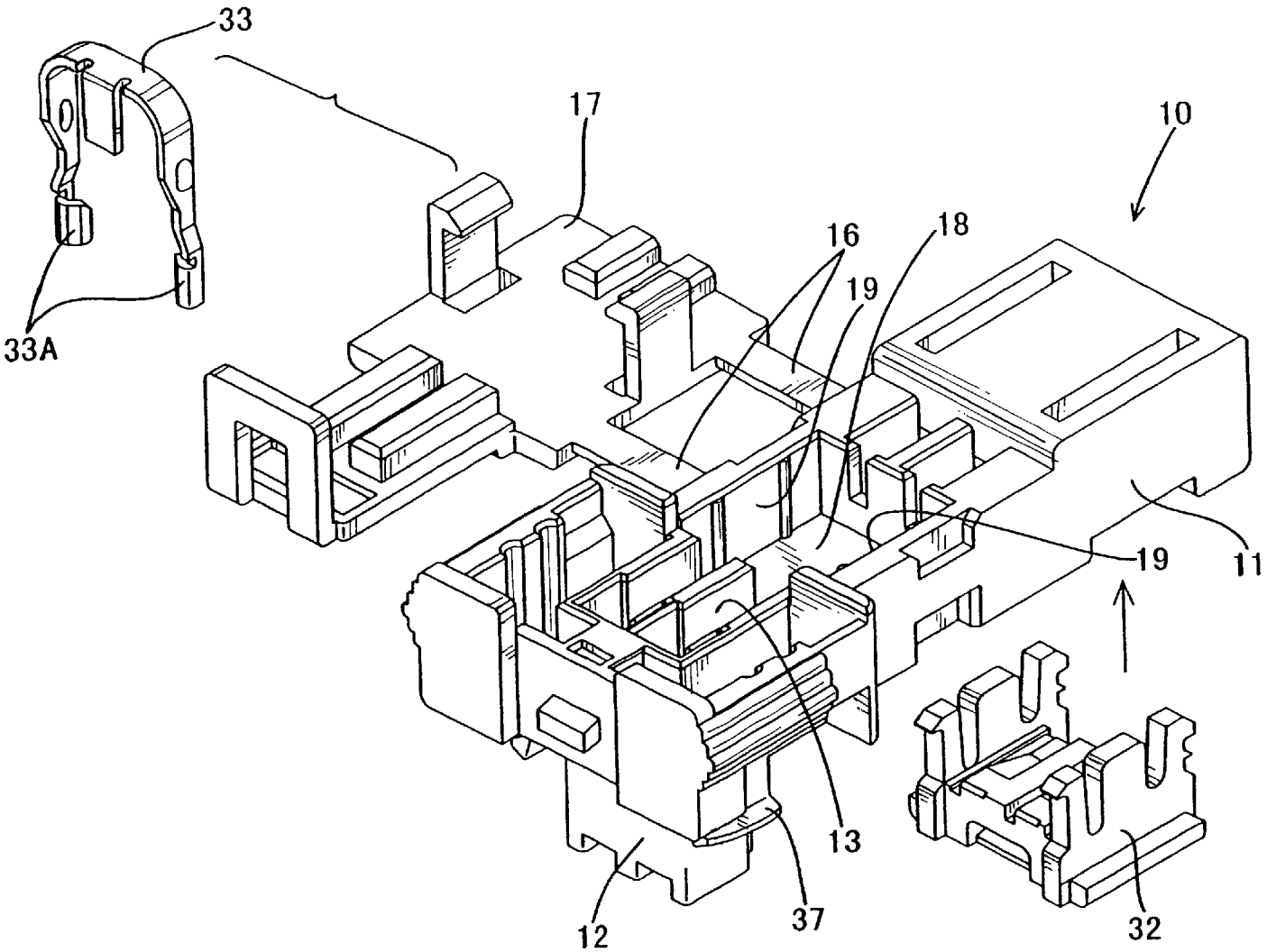
FIG. 1 is a disassembled diagonal view of a first embodiment of the invention.
Figure 2:
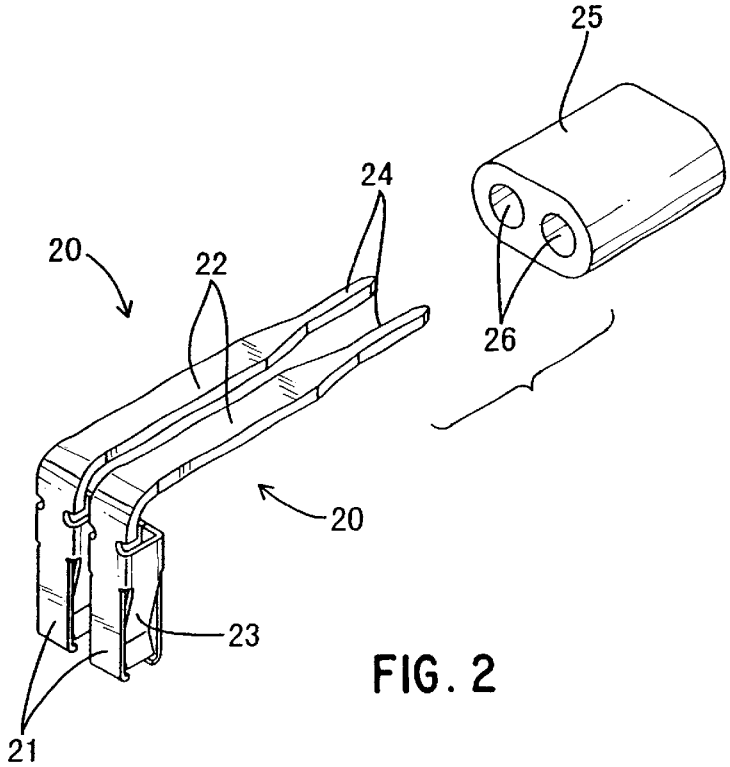
FIG. 2 is a disassembled diagonal view showing joint terminal fittings and a ferrite core.
Figure 3:
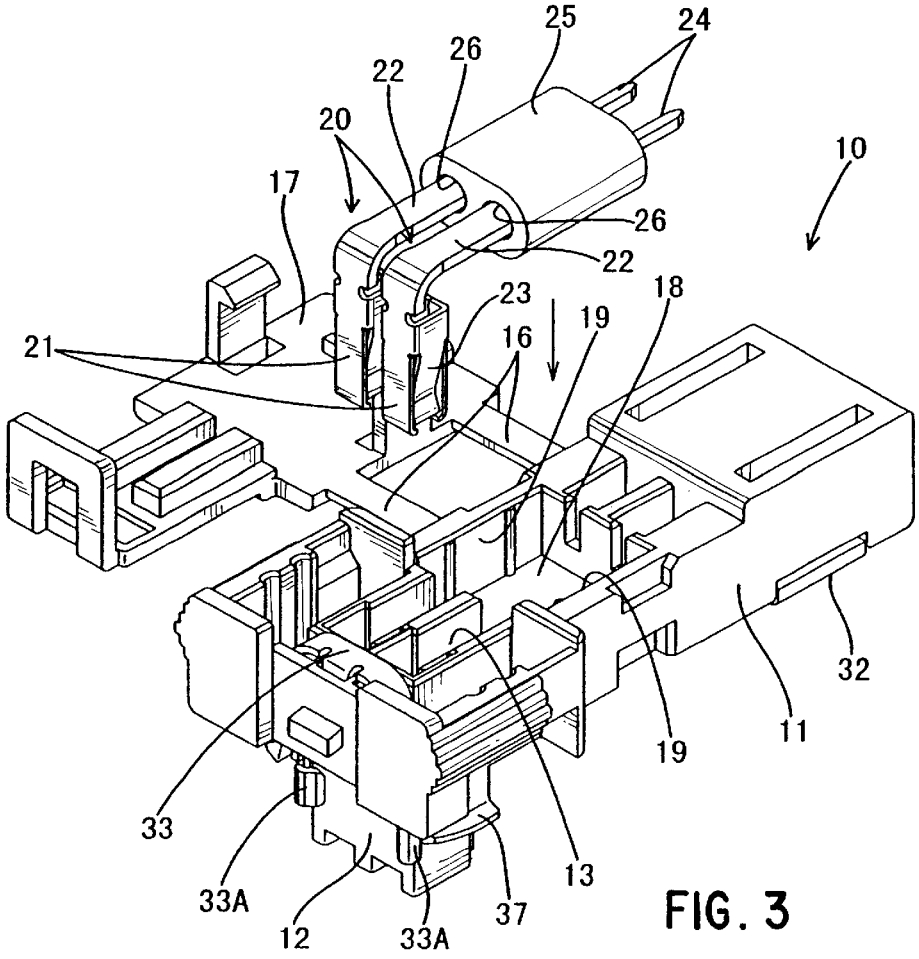
FIG. 3 is a diagonal view showing the joint terminal fittings, to which the ferrite core has been attached, in a state prior to being attached to a housing.

An embodiment of the present invention is described below with the aid of FIGS. 1 to 9.

A connector of the present embodiment is formed from a housing 10, two joint terminal fittings 20, a ferrite core 25, and two electric wire terminal fittings 27.

The housing 10 is made from plastic, and is composed from a main body 11 which extends in an anterior-posterior direction, and a fitting member 12 which protrudes downwards from an anterior end of the main body 11. The fitting member 12 fits with a corresponding connector (not shown). First, second and third cavities 13, 14 and 15, for housing the joint terminal fittings 20, the electric wire terminal fittings 27, and the ferrite core 25, are formed in the housing 10. The first cavities 13 extend a long the anterior-posterior direction of the main body 11, occupy approximately two thirds of the region of the housing 10 in the anterior-posterior direction, and open out onto an upper face of this housing 10. This opening portion at the upper faces can be covered by a cover 17 which is joined by a hinge 16 to an edge of the upper face of the housing 10. Grooves 18 and 19 are formed in a base face and left and right side faces of the first cavities 13. These grooves 18 and 19 house the ferrite core 25. The second cavity 14 (the housing space of the present invention) extends in an up-down direction, joins with anterior lower faces of the first cavities 13, and opens into a lower end face of the fitting member 12. The joint terminal fittings 20 and the ferrite core 25 are housed in the first cavities 13 and the second cavity 14. The third cavities 15 (the inserting spaces of the present invention) extend along the anterior-posterior direction of the main body 11, join with posterior ends of the first cavities 13, and open onto a posterior end face of the housing 10. The electric wire terminal fittings 27 a reinserted into the third cavities 15 from the posterior.

The joint terminal fittings 20 are formed by punching from electrically conductive metal sheet, and then bending into a specified shape. Each joint terminal fitting 20 has an L-shape when viewed from the side and has a box-like connecting member 21 which faces downwards, and an attaching member 22 which extends towards the posterior from an upper side of the box-shaped connecting member 21. Upper and lower sides of the box-shaped connecting member 21 are open, a portion of wall members thereof forming resilient contacting members 23 which make resilient contact with a corresponding terminal fitting (not shown) which has been inserted into the box-shaped connecting member 21. The box-shaped connecting member 21 and the attaching member 22 are inserted into the first cavities 13 and the second cavity 14, respectively, by being placed therein from above. The attaching member 22 has a simple long and narrow flat-shape which has a specified width. A narrow pin-shaped connecting member 24, which protrudes towards the posterior, joins the posterior end of the attaching member 22 (at the end opposite the box-shaped connecting member 21). The ferrite core 25 can be attached to the attaching member 22 of this joint terminal fitting 20.

The ferrite core 25 reduces noise along a conductive path formed from electric wires 36, the electric wire terminal fittings 27 and the joint terminal fittings 20. The ferrite core 25 has an oblong shape when viewed from the anterior-posterior direction, and a left and right pair of attachment holes 26 pass therethrough in the anterior-posterior direction. These attachment holes 26 are round, their inner diameter being the same or slightly less than the width of the attaching members 22 of the joint terminal fittings 20.

Each electric wire terminal fitting 27 (FIG. 6) is formed by punching from electrically conductive metal sheet, and then bending into a specified shape. The electric wire terminal fittings 27 are long and narrow in the anterior-posterior direction. An anterior half thereof forms box-shaped connecting members 28, and a posterior half thereof forms electric wire crimping members 29. Anterior and posterior ends of the box-shaped connecting members 28 are open, and resilient contacting members (not shown) are formed therein, these making resilient contact with the pin-shaped connecting member 24 which has been inserted into the box-shaped connecting member 28. A lance 30, which retains the electric wire terminal fittings 27 inserted into the third cavities 15, is formed on a lower face of each box-shaped connecting member 28. A stepped portion of a lower edge of a posterior side of each box-shaped connecting member 28 forms a stopping member 31 which, in conjunction with a retainer 32, doubly retains the electric wire terminal fittings 27. The electric wire crimping members 29 form a pair of anterior and posterior barrels 29F and 29R. The anterior barrel 29F crimps core wires of the electric wires 32 which have been exposed by cutting away their insulation, and the posterior barrel 29R crimps portions of the electric wires 36 which are covered by the insulation. This crimping is performed simultaneously by the anterior and posterior barrels 29F and 29R by means of an automated device (not shown).

The connector of the present embodiment is also provided with the retainer 32, a short-circuit releasing member 33, and a fitting detecting member 34. A brief description of their configuration and function follows.

The retainer 32 is attached from a lower face of the posterior end of the main body 11. It faces into the third cavity, and can be moved between a temporary retaining position which allows the electric wire terminal fittings 27 to be inserted (see FIG. 8), and a main retaining position (see FIG. 9). When the electric wire terminal fittings 27 are inserted into the third cavities 15, the lances 30 engage with lance holes 35 located at lower faces of the posterior ends of the cavities 13, thereby retaining the electric wire terminal fittings 27. Then the retainer 32 is pushed into the main retaining position and the retainer 32 engages from the posterior with the stopping member 31, thereby doubly retaining the electric wire terminal fittings 27.

The short-circuit releasing member 33 has an inverted U-shape when seen from the anterior, and is attached from above to an anterior end of the housing 10 (to the anterior of the first cavities 13). This short-circuit releasing member 33 has a left and right pair of resilient releasing protrusions 33A which protrudes downwards below the main body 11. These can be moved between an open, short-circuiting, position (see FIG. 1), and a closed, short-circuit releasing, position (not shown).

The fitting detecting member 34 is attached from above to the housing 10 in the same manner as the short-circuit releasing member 33, and can be moved between a waiting position (not shown; in this position detecting protrusions 34A are adjacent to the posterior of locking members 37. which protrude along side faces of the fitting member 12 at the anterior lower face of the main body 11 of the housing 10), and an operating position (not shown; in this position the detecting protrusions 34A are located in spaces between the locking members 37 and the fitting member 12).

When the connector of the present embodiment is to be fitted with the corresponding connector, the short-circuit releasing member 33 is in the short-circuiting position, and the fitting detecting member 34 is in the waiting position. From this state, the fitting detecting member 34 is moved to the anterior towards the operating position, and this fitting detecting member 34 bends the resilient releasing protrusions 33A of the short-circuit releasing member 33 into the short-circuit releasing position, so that the resilient releasing protrusions 33A move short-circuiting terminal fittings (not shown) of the corresponding connector away from corresponding terminal fittings. If the connector is not fully fitted with the corresponding connector, the locking members 37 are bent towards the fitting member 12. In such a case, if the fitting detecting members 34 are pushed into the operating position, the detecting protrusions 34A strike against the locking members 37 from the posterior. This prevents the fitting detecting member 34 from moving. This prevention of movement allows one to detect that the two connectors are not correctly fitted.

Next, the operation of the present embodiment will be described.

The order of attachment is as follows. Firstly, the short-circuit releasing member 33 and the retainer 32 are attached to the housing 10 from the state shown in FIG. 1.

Furthermore, the ferrite core 25 is attached to the two joint terminal fittings 20. When the ferrite core 25 is to be attached, the attaching members 22 (with the pin-shaped connecting members 24 being fitted foremost) are fitted with the attachment holes 26 of the ferrite core 25. In their attached state, left and right side edges of the attaching members 22 rub against inner circumference faces of the attachment holes 26, thereby preventing the ferrite core 25 and the joint terminal fittings 20 from separating.

Figure 4:
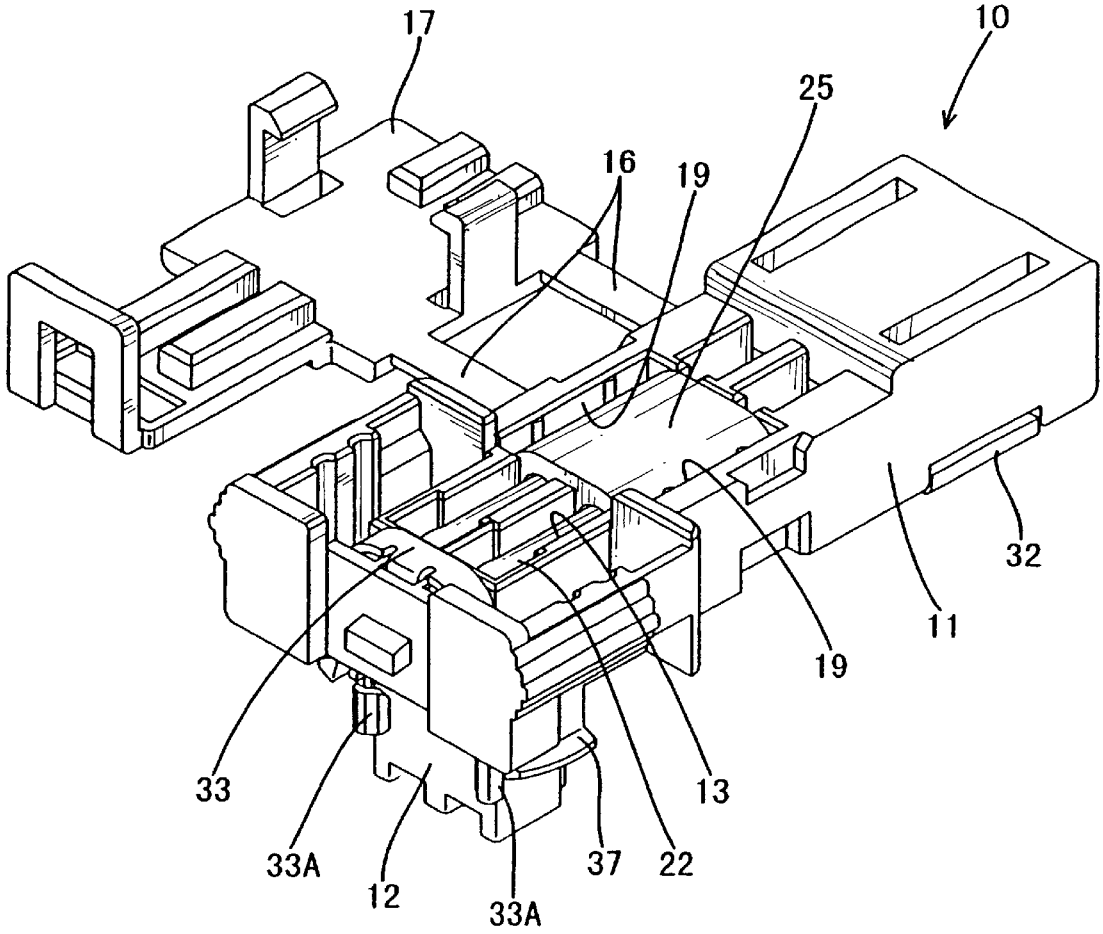
FIG. 4 is a diagonal view showing joint terminal fittings attached to the housing.
Figure 5:
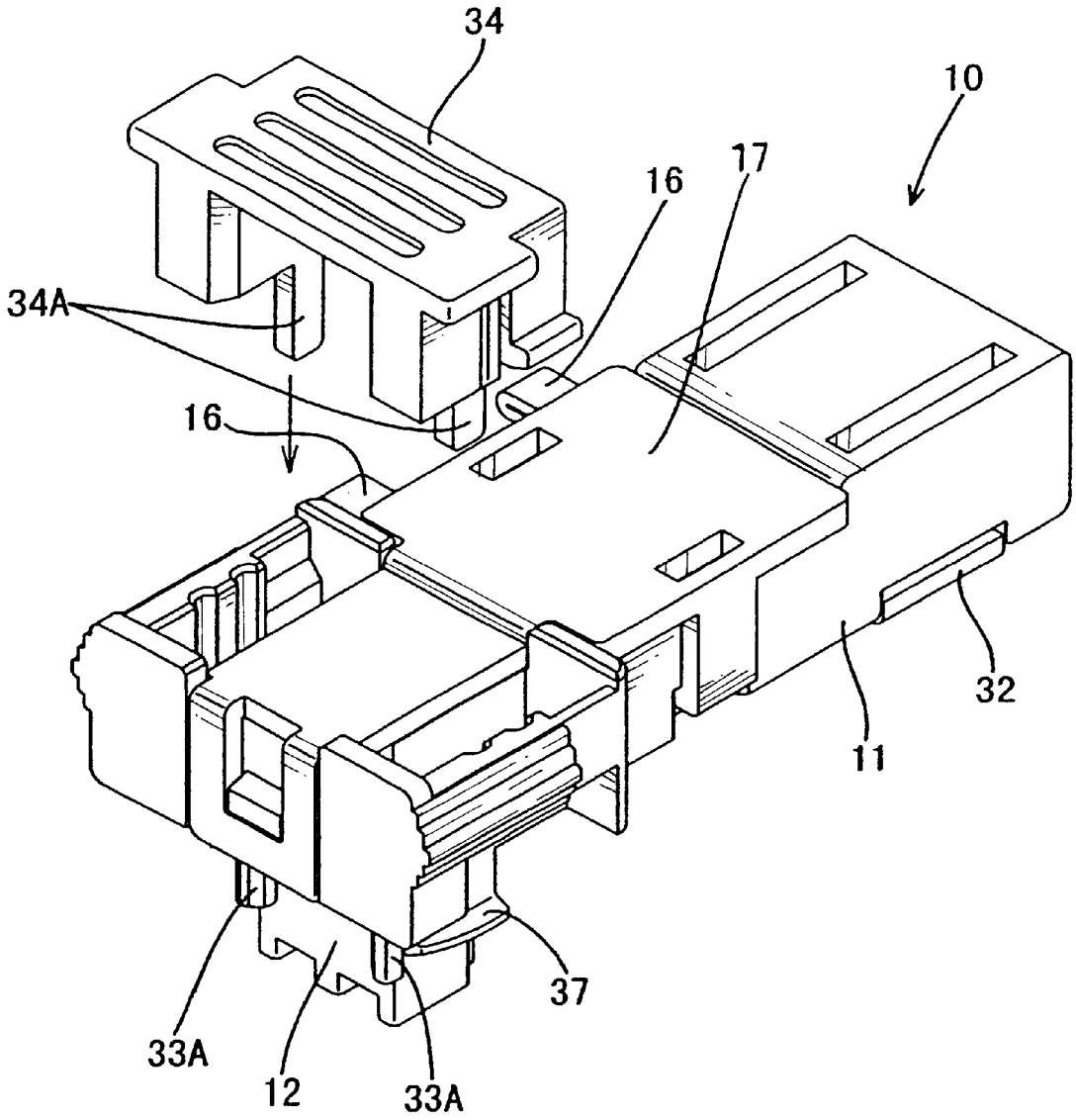
FIG. 5 is a diagonal view showing a fitting detecting member prior to being attached to the housing.
Figure 6:
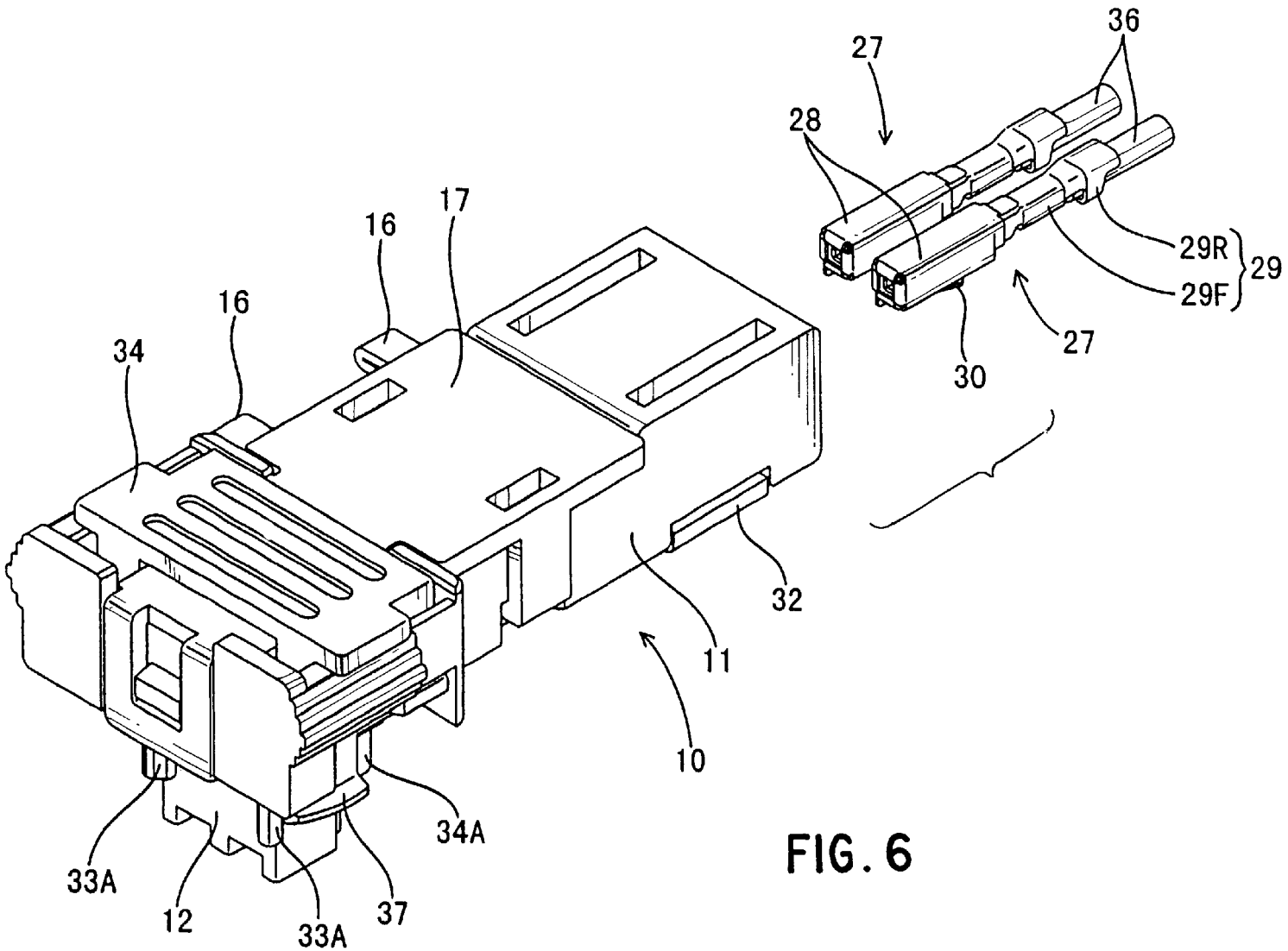
FIG. 6 is a diagonal view showing electric wire terminal fittings prior to being attached to the housing.
Figure 7:
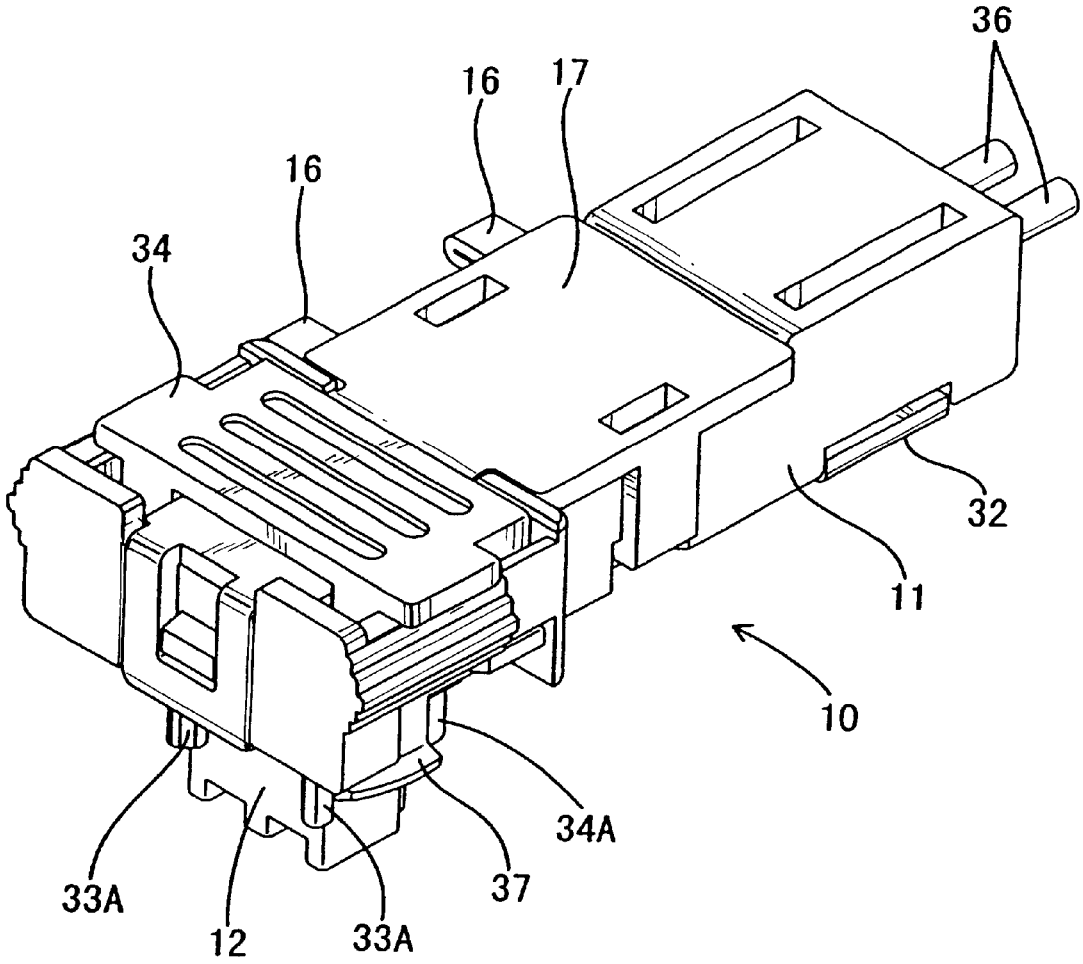
FIG. 7 is a diagonal view showing the electric wire terminal fittings attached to the housing.
Figure 8:
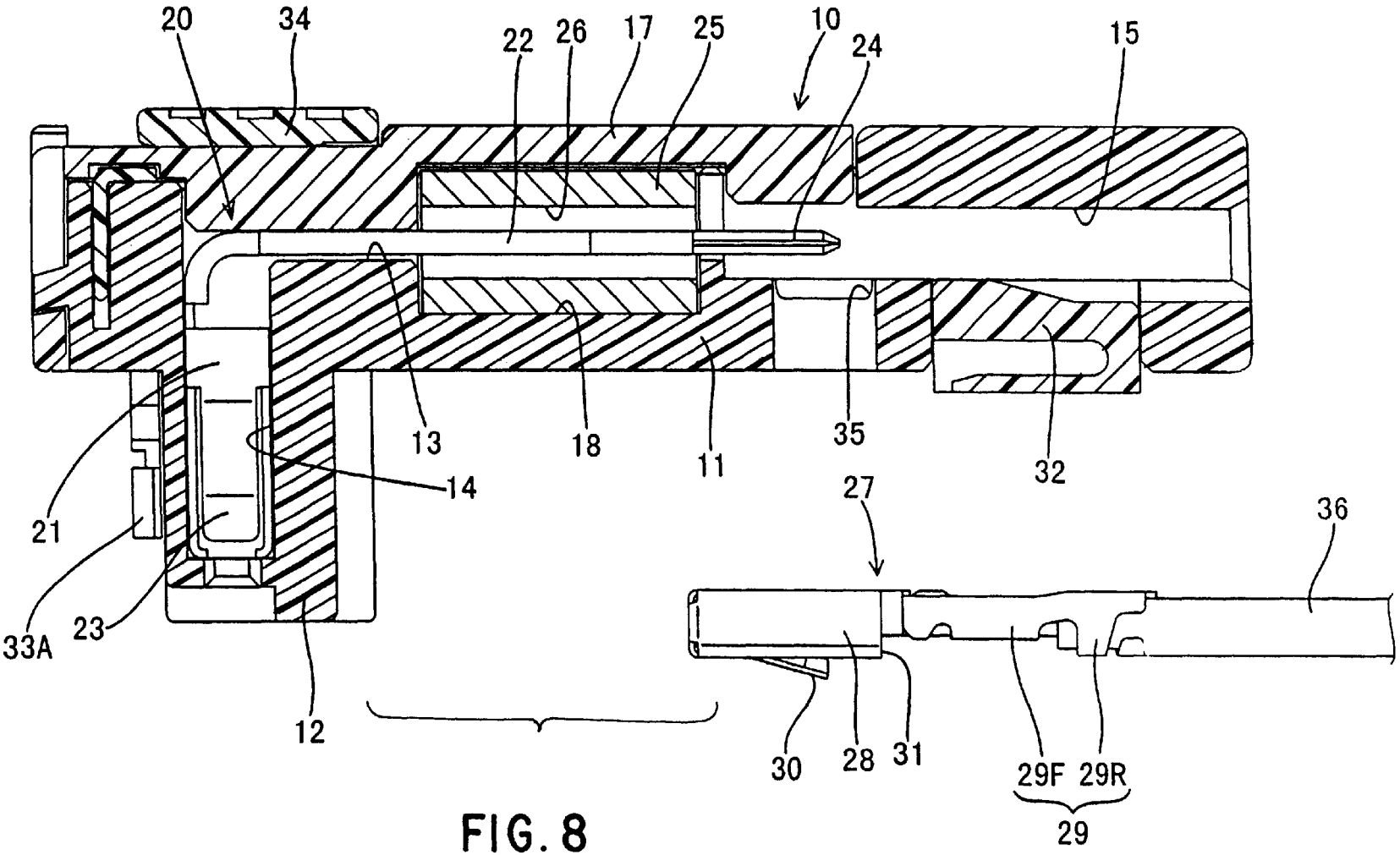
FIG. 8 is a cross-sectional view showing the electric wire terminal fittings prior to being attached to the housing.
Figure 9:
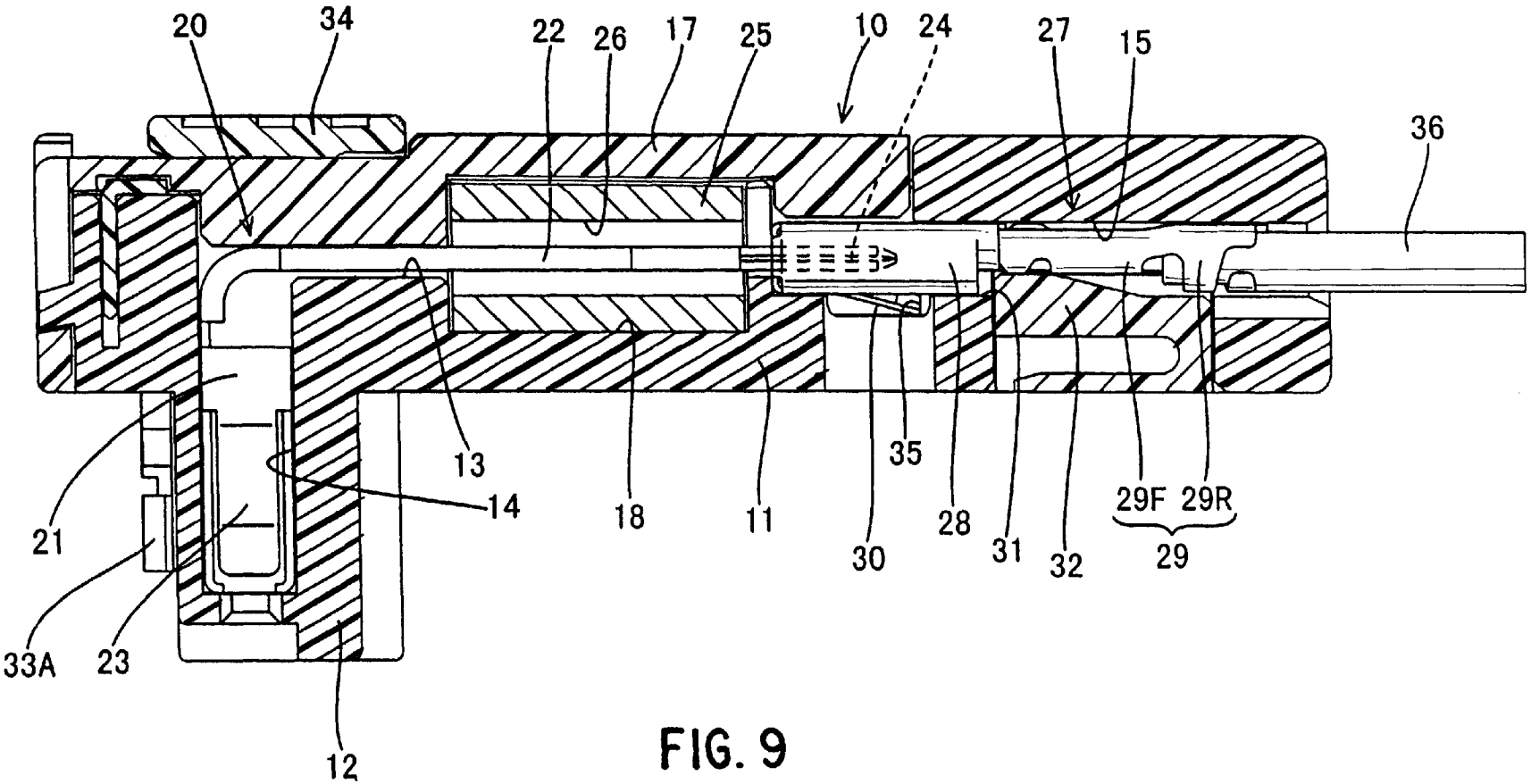
FIG. 9 is a cross-sectional view showing the electric wire terminal fittings attached to the housing.

Next, as shown in FIG. 4, the joint terminal fittings 20, which have the ferrite core 25 attached thereto, are housed within the first cavities 13 and the second cavity 14. At this juncture, the pin-shaped connecting members 24 are positioned opposite the anterior ends of the third cavities 15 which are located at the posterior ends of the first cavities 13. Furthermore, the ferrite core 25 is housed within the grooves 18 and 19 of the first cavities 13, thereby regulating its movement in the anterior-posterior and left-right direction. Moreover, the cover 17 is closed so as to cover the upper face of the housing 10 (see FIG. 5). By this means, the joint terminal fittings 20 and the ferrite core 25 are housed within the housing 10 in a manner whereby they cannot be removed from above and their movement is regulated. Next, as shown in FIG. 6, the fitting detecting member 34 is attached to the housing 10.

Furthermore, in a separate operation, an automated device crimps the electric wires 36 and the electric wire terminal fittings 27. The crimped electric wire terminal fittings 27 are inserted from the posterior into the third cavities 15 of the housing 10. Then the box-shaped connecting members 28 of the electric wire terminal fittings 27 fit around the pin-shaped connecting members 24, thereby making resilient contact therewith. In this manner, the attachment operation of the connector of the present embodiment is completed.

In the present embodiment, as has been described above, the joint terminal fittings 20, which have the ferrite core 25 fitted to their exterior, are formed separately from the connecting members (that is, the electric wire terminal fittings 27) of the electric wires 36. Consequently, an automated device is able to connect the electric wire terminal fittings 27 and the electric wires 36, and operability thereby improves.

Further, the operation for housing the ferrite core 25 and the joint terminal fittings 20 within the housing 10 is performed separately from the operation for attaching the electric wire terminal fittings 27 to the housing 10. This permits a division of labour for the two operations (for example, the ferrite core 25 and the joint terminal fittings 20 may be attached at one work-site, and the electric wire terminal fittings 27 may be attached at another work-site).

The present invention is not limited to the embodiment described above with there aid of figures. For example, the possibilities described below also lie within the technical range of the present invention. In addition, the present invention may be embodied in various other ways without deviating from the scope thereof.

(1) In the embodiment described above, the housing was a single component. However, according to the present invention, the housing may equally well be two components, comprising one portion for housing the ferrite core and the joint terminal fittings, and another portion for housing the electric wire terminal fittings, the joint terminal fittings being brought into contact with the electric wire terminal fittings by fitting the two components together.

(2) The male and female components of the connecting portions of each terminal fitting may be the reverse of those in the embodiment described above.

(3) In the embodiment described above, the conducting member is a joint terminal fitting which is formed from a single piece of metal. However, according to the present invention, the conducting member may be a short interrupted electric wire which has a terminal fitting fixed to one end thereof, this terminal fitting making contact with a corresponding terminal fitting, and the ferrite core being fitted from the exterior to this interrupted electric wire. In this case, the electric wire terminal fitting is placed into the housing as a crimped terminal fitting, the other end of the interrupted electric wire being crimped to this crimped terminal fitting.

(4) In the attachment operation of the embodiment described above, the conducting members and the ferrite core are first housed within the housing, then the electric wire terminal fittings are inserted into the housing. However, according to the present invention, the electric wire terminal fittings may be housed first, then the conducting members and the ferrite core may be housed within the housing. Furthermore, the electric wire terminal fittings and the conducting member may be attached to one another outside the housing, and then housed together within the housing.

(5) In the embodiment described above, two joint terminal fittings pass through one ferrite core. However, according to the present invention, one ferrite core may be attached to one joint terminal fitting.

(6) In the embodiment described above, the connector was provided with two terminals. However, the present invention is also suitable for three terminals or more.

What is claimed is:

1. A terminal fitting assembly comprising:

a housing having a cavity and a lance hole, a joint terminal fitting provided in the housing and having a first connection portion at one end thereof for connection to a terminal fitting of a mating connector and a second connection portion at an opposite end thereof, a wire terminal fitting inserted into the cavity of the housing and having a lance, a first connecting portion at one end thereof and a second connecting portion at an opposite end adapted to attach to a wire, the second connection portion of the joint terminal fitting and the first connecting portion of the wire terminal fitting being releasably coupled together, the lance engaging the lance hole when the wire terminal fitting is inserted into the cavity, and a noise shielding member substantially surrounding the joint terminal fitting to shield an electrical circuit formed by the terminal fitting assembly against electrical noise.

2. The terminal fitting assembly according to claim 1, wherein said joint terminal fitting extends through said noise shielding member whereby said noise shielding member is provided between said ends of said joint terminal fitting.

3. The terminal fitting assembly according to claim 2 wherein said second connection portion of the joint terminal fitting is tab-like and said first connection of the joint terminal fitting portion is box-like, and wherein said noise shielding member is provided with a through hole adapted to permit said second connection portion of the joint terminal fitting to extend therethrough.

4. The terminal fitting assembly according to claim 1, wherein said second connection portion of the joint terminal fitting is tab-like and said first connection portion of the joint terminal fitting is box-like, and wherein said noise shielding member is provided with a through hole adapted to permit said second connection portion of the joint terminal fitting to extend therethrough.

5. The terminal fitting assembly according to claim 1, wherein said joint terminal fitting is L-shaped, and defines two legs, one leg forming said second connection portion which extends from the other leg via a bend, wherein said one leg extends through said noise shielding member, whereby said noise shielding member is provided between said one end and said bend.

6. The terminal fitting assembly according to claim 1, wherein said joint terminal fitting is formed from a one-piece metal sheet component.

7. An electrical connector comprising the terminal fitting assembly according to claim 1, and a connector housing in which said terminal fitting assembly is accommodated.

8. An electrical connector according to claim 1, wherein said joint terminal fitting protrudes in an attachment direction, and said housing defines a cavity in said attachment direction an aligned with said joint terminal fitting to permit insertion of a terminal fitting from the exterior for engagement with said joint terminal fitting.

9. An electrical connector according to claim 8 and having two joint terminal fittings adapted for respective engagement with respective electrical terminal fittings, said noise shielding member consisting of a ferrite core comprising a single component having two apertures therein, one aperture for each joint terminal fitting.

10. An electrical connector according to claim 1, and having two joint terminal fittings adapted for respective engagement with respective electrical terminal fittings, said noise shielding member consisting of a ferrite core comprising a single component having two apertures therein, one aperture for each joint terminal fitting.

11. An electrical connector according to claim 10, wherein said ferrite core is substantially oval in section, and has flat ends between which said two apertures extend.

12. An electrical connector according to claim 9, wherein said ferrite core is substantially oval in section, and has flat ends between which said two apertures extend.

13. A terminal fitting assembly in accordance with claim 1 in which one of the second connection portion of the joint terminal fitting and the first connecting portion of the wire terminal fitting constitutes a male member and the other a female member, wherein the male and female members are releasable mating components.

* * * * *